United States Patent [19]

Mueller-Storz et al.

[11] Patent Number: 4,633,664

[45] Date of Patent: Jan. 6, 1987

[54] OPEN-END ROTOR SPINNING APPARATUS

[76] Inventors: Hans-Friedrich Mueller-Storz, Dietweg 25, 8074 Gaimersheim; Erich Bock, Rosenstrasse 11-1/2, 8071 Wettstetten, both of Fed. Rep. of Germany

[21] Appl. No.: 619,845

[22] Filed: Jun. 12, 1984

[30] Foreign Application Priority Data

Jul. 22, 1983 [DE] Fed. Rep. of Germany ..... 3326405

[51] Int. Cl.[4] ..... D01H 7/882

[52] U.S. Cl. ..... 57/406; 57/100

[58] Field of Search ..... 57/404, 406, 407, 400, 57/413, 416, 100

[56] References Cited

U.S. PATENT DOCUMENTS

| | | | |
|---|---|---|---|
| 3,524,312 | 8/1970 | Landwehrkamp et al. | 57/404 X |
| 3,861,132 | 1/1975 | Stahlecker et al. | 57/407 |
| 3,990,225 | 11/1976 | Hortlik et al. | 57/407 |
| 4,022,008 | 5/1977 | Pimiskern et al. | 57/406 X |
| 4,117,359 | 9/1978 | Wehde | 57/406 X |
| 4,144,707 | 3/1979 | Stahlecker | 57/406 |
| 4,242,858 | 1/1981 | Dschen | 57/406 X |
| 4,306,166 | 12/1981 | Quandt | 57/406 X |

*Primary Examiner*—Stuart S. Levy
*Assistant Examiner*—Joseph J. Hail, III
*Attorney, Agent, or Firm*—Julian W. Dority

[57] ABSTRACT

In an open-end rotor spinning apparatus, the driven rotor shaft (2) of the spinning rotor (1) is mounted by means of bearing members (20) for rotation in a casing (3) which is inserted into a mounting on the machine. The replacement of the spinning rotor (1) together with the bearing casing (3), without exerting a load on the bearings, is made possible by a flange (60) which is disposed on the bearing casing (3) and which extends along the rear side of the spinning rotor (1) and projects at least over the major diameter of the spinning rotor. During replacement of the rotor, the flange (60) serves as a handle, and in normal operation it serves as an additional cooling means for the bearings. By means of a ring (61) mounted on the flange (60), it is possible to form a casing (6) which is open at the front and which, with slight clearance, surrounds the outside contour of the spinning rotor (1) and reduces the consumption of energy.

10 Claims, 2 Drawing Figures

OPEN-END ROTOR SPINNING APPARATUS

BACKGROUND OF THE INVENTION

The invention relates to an open-end rotor spinning apparatus having a spinning rotor which in operation rotates in a rotor casing held under negative pressure. The spinning rotor has a driven shaft that is mounted by means of bearing members for rotation in a casing, the casing being inserted into a mounting on the machine.

In open-end rotor spinning machines, it is necessary for technological reasons to replace the spinning rotors by others of a different size and shape. In apparatus in which the rotor shaft carrying the spinning rotor is mounted indirectly in the wedge gap of supporting rollers, this replacement presents no difficulties because the rotor shaft, together with the spinning rotor, can be drawn out of the supporting roller mounting in the forward direction towards the operator's side of the machine without any problem, and a rotor shaft carrying a different spinning rotor can then be inserted. However, in the case of direct mounting of the rotor shaft, this is not immediately possible. The rolling-contact bearings are usually fastened by pressing them onto the rotor shaft, and the bearings are in turn pressed into the bearing casing, so that the replacement of the rotor is possible only with the aid of tools and the application of considerable force, with the result that damage to the bearing can scarcely be avoided.

An apparatus is now known, in which the spinning rotor, together with the casing holding the bearing members of the rotor shaft, is inserted into a bore in a receptacle wall and is aligned in position and fastened by spring-loaded balls corresponding to cutouts in the casing (German Patent Specification No. 2,517,973). This arrangement permits the replacement of the spinning rotor together with the casing holding the bearing members. It is, however, a disadvantage that during the extraction of the casing out of the bore in the forward direction towards the operator's side and the insertion of a casing with a different spinning rotor, the bearings are subjected to tensile or compressive forces via the rotor shaft. Frequent replacement is therefore detrimental to the life of the bearings.

SUMMARY OF THE INVENTION

The object of the present invention is to make possible, in an open-end rotor spinning apparatus, the replacement of the spinning rotor, together with the casing holding the bearing members for the rotor shaft, without exerting any load on the bearings.

According to the invention, this problem is solved in that the casing holding the bearing members has an annular flange, which extends along the rear side of the spinning rotor and projects over the major or greatest diameter of the spinning rotor.

It is thus now possible, when changing the rotor to grip the bearing unit by the annular flange and, without exerting any force on the bearings, to push the bearing unit into or pull it out of the mounting on the machine from the operator's side. At the same time, however, the flange also serves as an additional cooling means for the bearings, the operating heat of which is dissipated via the casing holding the bearing members and via the flange.

Owing to the fact that the flange matches the shape of and surrounds the spinning rotor, with slight clearance, in the region of the major diameter of the spinning rotor, air turbulence affecting the energy consumption of the apparatus is avoided in the region covered by the flange, so that energy consumption is reduced. A further saving of energy and a lowering of the noise level are achieved through a ring that is detachably mounted on the flange and, together with the flange, forms a casing which is open at the front and which, with slight clearance, surrounds the outside contour of the spinning rotor. Rapid fitting and removal of the ring are made possible by the fact that the ring is connected to the flange by a bayonet fastening. Owing to the fact that the flange is detachably fastened on the casing holding the bearing members, it can be replaced by flanges of different shapes. The casing holding the bearing members is expediently fixed axially by means of the flange. The axial fixing is preferably effected by means of a ball snap fastener, which at the same time fastens, with radial resiliency, the flange and the casing holding the bearing members and ensures that the damping action of a resilient support of the casing holding the bearing members, in the mounting on the machine, is restained. The resilient support is preferably provided by means of O-rings, which are disposed on the periphery of the casing holding the bearing members.

The construction designed to carry out the invention will be hereinafter described, together with other features thereof.

The invention will be more readily understood form a reading of the following specification and by reference to the accompanying drawing(s) forming a part thereof, wherein an example of the invention is shown and wherein:

DESCRIPTION OF A PREFERRED EMBODIMENT

Figure 1:
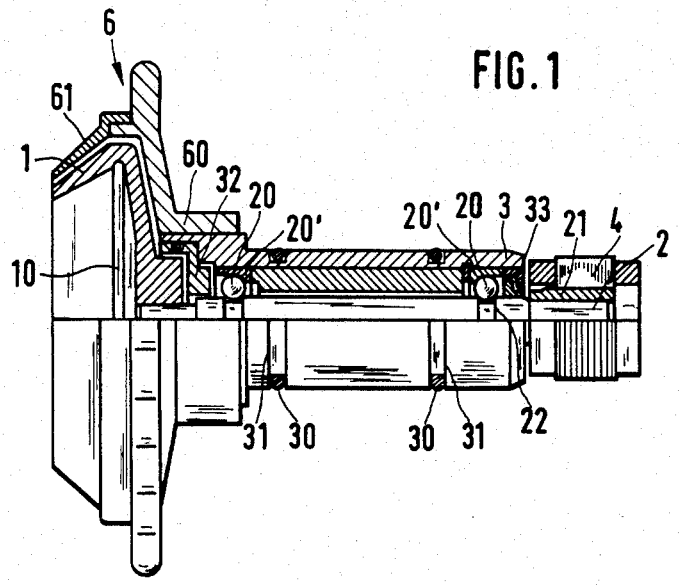
FIG. 1 shows a rotor shaft mounted in a bearing casing, together with a spinning rotor which is surrounded by a flange disposed on the bearing casing and supplemented to form a casing, in a partial longitudinal section.

FIG. 1 shows a spinning rotor 1 with a fiber collector channel 10, the rotor 1 being fixed on the free end of a rotor shaft 2. The rotor shaft 2 is mounted in ball bearings 20, which are situated in a tubular casing. This casing holding the bearing members will hereinafter be referred to as the bearing casing 3. The balls of the ball bearings 20 disposed near the two ends of the bearing casing 3 run in guide grooves 22, which are formed in the rotor shaft 2. The outer ring of the ball bearings is designated 20.

Figure 2:
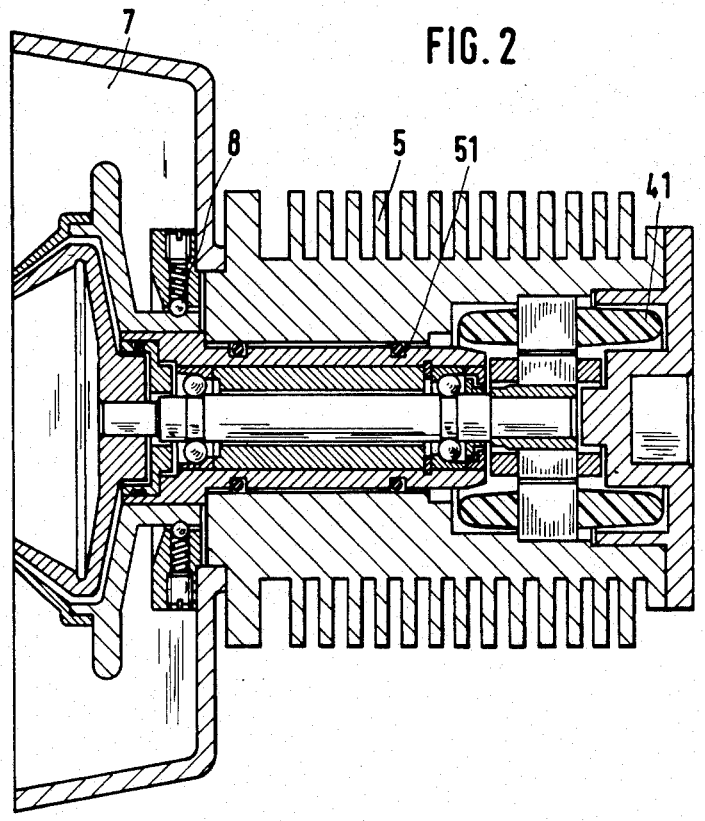
FIG. 2 is a longitudinal section of the unit shown in FIG. 1, installed at a spinning station in a stationary mounting.

At its free end remote from the spinning rotor 1, the rotor shaft 2 is driven in any desired manner. Individual electric drive is preferred, for example, by means of an asynchronous motor, the rotor 4 of which is fastened on the free shaft end with the interposition of a steel bush 21. A drive means in the form of a stator 41 of the electric motor is inserted into a motor casing 5, which is provided with cooling ribs (FIG. 2). O-rings 30 are mounted on the periphery of the bearing casing 3, near the two ball bearings 20, and are fastened in annular grooves 31. Instead of O-rings, other resilient damping means may also be used, such as rubber-metal springs, for example. Labyrinths 32 and 33 at the two outer ends of the bearing casing 3 seal the bearing.

At the end of the bearing casing 3 facing the spinning rotor, an annular flange 60 is disposed, which extends along the rear side of the spinning rotor and projects at least over the major diameter of the spinning rotor. There is a radial projection 60*a* which extends outwardly of the annular flange to provide a handle for removing the apparatus and an axial projection 60*b* extending generally axially over the rotor. In the preferred embodiment illustrated, the interior of the flange 60 matches the shape of the rear side of the spinning rotor 1, and the flange surrounds the spinning rotor 1, with slight clearance, up to the region of its major or greatest diameter of the spinning rotor 1. The flange 60, like the bearing casing 3, is made of a material which is a good conductor of heat, and is expediently connected detachably to the bearing casing 3, so that it is exchangeable and so that spinning rotors of a different shape can be fitted. The flange 60 may, however, also be an integral part of the bearing casing 3.

Through the arrangement of the annular flange 60 on the bearing casing 3, a handle is formed. When it is desired to replace the bearing casing 3 with a bearing casing of a spinning rotor having a different size and/or shape, the handle enables the bearing casing 3, together the rotor shaft 2 mounted in it and carrying the spinning rotor 1, to be inserted into and pulled out of a mounting on the machine, from the operator side of the machine, without exerting a load on the bearings. The flange 60 also serves in normal operation as an additional cooling means for the bearing system, and to a large extent prevents air turbulence on the rear side of the spinning rotor, thus having a favorable effect on the energy consumption of the apparatus. In order to obtain a still larger cooling means and to reduce still further the consumption of energy, while also lowering the noise level, a ring 61 is detachably fastened on the flange 60, so that the spinning rotor 1 is enclosed in a casing that is open at the front. The casing formed by the flange 60 and the ring 61, given the general reference 6, has an inside contour matching the outside contour of the spinning rotor 1 and surrounds the spinning rotor 1 with a predetermined slight clearance. The ring 61 also consists of a material which is a good conductor of heat, and in the region of the largest diameter of the spinning rotor 1, is fastened by a bayonet connection to the flange 60.

The motor casing 5, is inserted, with accurate fitting, into a bore in the rear wall of the spinning chamber casing 7, and in turn is provided with a bore 51 (FIG. 2).

The bearing unit shown in FIG. 1 is gripped by the annular flange 60 or by the ring 61 and pushed into the bore 51 until the spring-loaded ball of a ball snap fastener 8, which is mounted to the rear wall of the spinning chamber casing 7, engages in the annular projection of the flange 60, mounted on the bearing case 3. The bearing casing 3, which holds the bearing members for the rotor shaft 2, is thus fixed axially by means of the flange 60. To ensure secure fastening, two ball snap fasteners 8, lying opposite one another, are provided. Since the diameter of the electric motor rotor 4 fastened on the rotor shaft 2 is smaller than the diameter of the bore 51, the insertion of the bearing casing 3 into its mounting is not hindered by the rotor 4. Preference is given to the fastening of the flange 60 and of the bearing casing 3 by means of a ball snap fastener, rather than other possible fasteners. With this form of attachment, in addition to axial fastening, a radially resilient fastening of the flange 60 and of the casing 3 holding the bearing members is achieved at the same time. Consequently, the damping properties of the O-rings 30 which are disposed on the periphery of the bearing casing 3, and which effect the centering of the bearing casing 3 in the bore 51, are retained and the ease of movement of the bearing casing 3 in the bore 51 is not hindered.

With this arrangement, it is ensured that in normal operation, during which the spinning chamber casing 7 is closed in known manner by a cover (not shown) containing a fiber feed channel and a yarn draw-off channel and is under negative pressure, there will be no relative movement between the spinning rotor 1 and the casing 6 formed by the flange 60 and the ring 61. The casing 6, which is disposed on the resiliently mounted bearing casing 3 and surrounds the spinning rotor 1, vibrates with the spinning rotor 1. The casing 6 can therefore lie only a short, accurately defined radial distance from the spinning rotor 1, without incurring the risk of damage. In addition, because of the close concentric arrangement of the spinning rotor 1 relative to the casing 6, an excessive pump action, which would lead to increased air friction losses, it prevented on the rotating spinning rotor 1. The accurately defined adaptation of the shape of the spinning rotor 1 to that of the casing 6 thus permits a saving of driving energy, which at the maximum rotational speeds of the spinning rotor 1; for example, 100,000 r.p.m. and higher, is considerable.

The bearing heat produced during operation is dissipated via the motor casing 5, from which the bearing casing 3, mounted by means of O-rings, is separated only by a minimal air gap, and additionally via the flange 60, which is disposed on the bearing casing 3, or the casing 6. Adequate cooling of the apparatus is thus ensured, even for high operating speeds of rotation.

The invention is not restricted to apparatus in which the rotor shaft is mounted in ball bearings. It can also advantageously be used with other types of bearings.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

What we claim is:

1. An open-end rotor spinning apparatus for use on an open-end spinning machine comprising:

(a) an open-end spinning rotor having a major diameter;

(b) a bearing casing;

(c) bearing members mounted in said bearing casing;

(d) a driven rotor shaft mounted by said bearing members for rotation in said bearing casing;

(e) a mounting on said open-end spinning machine in which said bearing casing is inserted;

(f) drive means for driving said rotor shaft;

(g) flange means for said bearing casing comprising:

(1) an annular flange carried by said bearing casing;

(2) said annular flange extending along the rear side of the spinning rotor to project over said major diameter of the spinning rotor, the portion of the flange extending over the rear side of the rotor being axially spaced apart from the mounting and cooperating therewith to define a space therebetween adequate to permit said flange to be grasped; and (3) said annular flange thereby providing a handle by which said spinning rotor together with said bearing casing may be removed from said mounting without removing said mounting.

2. An open-end rotor spinning apparatus as set forth in claim 1, wherein said annular flange is contoured to follow the shape of said spinning rotor such that said annular flange surrounds said spinning rotor up to the region of the major diameter of said spinning rotor.

3. An open-end rotor spinning apparatus as set forth in claim 1, wherein a ring is detachably mounted on said annular flange and together with said annular flange forms said rotor casing, said rotor casing being open adjacent said open end of said spinning rotor, and said rotor casing surrounding said spinning rotor with minimal clearance.

4. An open-end rotor spinning apparatus as set forth in claim 3, wherein said ring is connected to said annular flange by a bayonet fastening.

5. An open-end rotor spinning apparatus as set forth in claim 1, wherein said annular flange is fastened detachably on said bearing casing.

6. An open end rotor spinning apparatus as set forth in claim 1, including axial fastening means carried by said annular flange for axially fixing said bearing casing in said mounting.

7. An open-end rotor spinning apparatus as set forth in claim 6, wherein said axial fastening means includes a ball snap fastener having a fastening element radially resiliently urged against said annular flange.

8. An open-end rotor spinning apparatus as set forth in claim 1, including O-rings carried about the periphery of said bearing casing.

9. An open-end rotor spinning apparatus for use on an open-end spinning machine comprising:

(a) an open-end spinning rotor having a major diameter;

(b) a bearing casing;

(c) bearing members mounted in said bearing casing;

(d) a driven rotor shaft mounted by said bearing members for rotation in said bearing casing;

(e) a mounting on said open-end spinning machine in which said bearing casing is inserted; and (f) drive means for driving said rotor shaft;

(g) flange means for said bearing casing comprising:

(1) an annular flange carried by said bearing casing, said flange extending along a rear side spinning rotor; the portion of said flange which extends along a rear side of said rotor being axially spaced apart from said mounting;

(2) a radial projection included in said flange extending outwardly and away from said spinning rotor said projection cooperating with said mounting to define a space therebetween adequate to permit said projection to be grasped; and (3) said radial projection thereby providing a handle by which said spinning rotor together with said bearing casing may be removed from said mounting without removing said mounting.

10. An open-end rotor spinning apparatus as set forth in claim 9, wherein said annular flange has an axial projection extending over said major diameter of said spinning rotor, generally perpendicular to said radial projection.

* * * * *